US012150538B2

(12) United States Patent
Berhault

(10) Patent No.: US 12,150,538 B2
(45) Date of Patent: Nov. 26, 2024

(54) WIPER FOR A COSMETIC PRODUCT APPLICATOR, ASSOCIATED DEVICE AND METHOD OF APPLICATION

(71) Applicant: L'OREAL, Paris (FR)

(72) Inventor: Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 364 days.

(21) Appl. No.: 17/625,153

(22) PCT Filed: Jul. 16, 2020

(86) PCT No.: PCT/EP2020/070159
§ 371 (c)(1),
(2) Date: Jan. 6, 2022

(87) PCT Pub. No.: WO2021/009291
PCT Pub. Date: Jan. 21, 2021

(65) Prior Publication Data

US 2022/0265026 A1 Aug. 25, 2022

(30) Foreign Application Priority Data

Jul. 16, 2019 (FR) ..... 19 08007

(51) Int. Cl.
*A45D 34/04* (2006.01)

(52) U.S. Cl.
CPC .... *A45D 34/046* (2013.01); *A46B 2200/1053* (2013.01)

(58) Field of Classification Search
CPC .. A45D 34/046; A45D 34/047; A45D 40/267; A45D 40/268
See application file for complete search history.

(56) References Cited

U.S. PATENT DOCUMENTS 6,343,607 B1 2/2002 Gueret
2001/0033766 A1 10/2001 Gueret
2007/0141862 A1* 6/2007 Gueret ..... A45D 34/047 439/66

(Continued)

FOREIGN PATENT DOCUMENTS

CN 102763972 A 11/2012
CN 105266346 A 1/2016

(Continued)

*Primary Examiner* — Cris L. Rodriguez
*Assistant Examiner* — Jennifer P Connell
(74) *Attorney, Agent, or Firm* — POLSINELLI PC

(57) ABSTRACT

The wiper (8) for a cosmetic product applicator (6) for a container (4) contains the cosmetic product, the wiper extending along a longitudinal axis (A-A') and defining an insertion direction of the applicator into the container from a proximal end of the wiper toward a distal end of the wiper. The wiper comprises: a tube (16) having a longitudinal axis (A-A'), the tube defining a distal region (30) of constant interior section; and a wiping lip (20) of the applicator of longitudinal axis (A-A'), having an interior section becoming narrower in the insertion direction of the applicator up to a distal passage orifice (44). The wiper comprises a connecting segment (18) connecting the distal region of the tube to a proximal end of the wiping lip, the interior section of the connecting segment (18) becoming wider along the insertion direction.

20 Claims, 3 Drawing Sheets

(56) References Cited

U.S. PATENT DOCUMENTS

| | | | | |
|---|---|---|---|---|
| 2013/0004227 | A1 | 1/2013 | Geuther et al. | |
| 2013/0129399 | A1* | 5/2013 | Limongi | A45D 40/267 401/16 |
| 2016/0015151 | A1* | 1/2016 | Balestrini | A45D 40/267 401/122 |
| 2016/0331104 | A1* | 11/2016 | Caulier | A45D 40/267 |
| 2017/0273441 | A1 | 9/2017 | Leonard et al. | |

FOREIGN PATENT DOCUMENTS

| | | | | |
|---|---|---|---|---|
| CN | 105828660 | A | 8/2016 | |
| CN | 106998878 | A | 8/2017 | |
| DE | 2550256 | A1 | 5/1977 | |
| FR | 2 330 353 | A1 | 6/1977 | |
| FR | 2 888 097 | A1 | 1/2007 | |
| GB | 1545627 | A * | 5/1979 | A45D 40/267 |
| JP | 2003 339439 | A | 12/2003 | |
| JP | 2003339436 | A | 12/2003 | |
| KR | 200242001 | Y1 * | 9/2001 | |
| KR | 20080005830 | U | 12/2008 | |

* cited by examiner

WIPER FOR A COSMETIC PRODUCT APPLICATOR, ASSOCIATED DEVICE AND METHOD OF APPLICATION

CROSS REFERENCE TO RELATED APPLICATIONS

This application is a National Phase filing under 35 U.S.C. § 371 of PCT/EP2020/070159 filed on Jul. 16, 2020; which application in turn claims priority to Application No. 19 08007 filed in France on Jul. 16, 2019. The entire contents of each application are hereby incorporated by reference.

BRIEF SUMMARY OF THE DISCLOSURE

The present invention relates to a wiper for a cosmetic product applicator for a container containing the cosmetic product, the wiper extending along a longitudinal axis and defining an insertion direction of the applicator into the container from a proximal end of the wiper toward a distal end of the wiper, the wiper comprising:

- a tube having a longitudinal axis, the tube defining a distal region of constant interior section; and
- a wiping lip of the applicator of longitudinal axis, having an interior section becoming narrower in the insertion direction of the applicator up to a distal passage orifice.

The wiper is in particular intended to wipe an applicator for a cosmetic product in a container receiving the product, such as a bottle.

The cosmetic product is for example a cosmetic care, coloring and/or makeup product for a bodily surface.

More generally, a cosmetic product is as defined in EC Regulation no. 1223/2009 by the European Parliament and Council dated Nov. 30, 2009, relative to cosmetic products.

The wipers are generally used to ensure the effective loading of product on an applicator for an effective application of a fluid cosmetic product on the user.

BACKGROUND OF THE DISCLOSURE

For certain types of cosmetic products, in particular viscous products such as mascara, the applicator must be covered with a sufficient quantity of product, to ensure a sufficient, but not excessive, application in order to prevent an excess of product from hindering the application.

To that end, it is known, for example from document FR 2,888,097 A1, to use a wiper comprising a wiping lip in order to remove the excess cosmetic product from the applicator when it passes through the wiper. Such a lip is connected to a neck of the wiper at its proximal end and is gripped at its distal end, defining a passage orifice of the applicator. The section of the passage orifice is chosen to ensure optimal wiping of the brush.

Such a wiper is effective, but is not fully satisfactory. Indeed, it is desirable to limit the force applied in order to pass the head of the applicator through the wiper. This would be possible by making the lip thinner, but would lead to manufacturing difficulties. Another possibility would be to modify the angle of the lip, but this would affect the loading of the product during the removal of the applicator.

DETAILS OF THE DISCLOSURE

One aim of the invention is to obtain a wiper making it possible to ensure optimal wiping while reducing the force to be applied in order to pass the head of the applicator through the wiper.

To that end, the invention relates to a wiper of the aforementioned type, characterized in that the wiper comprises a connecting segment connecting the distal region of the tube to a proximal end of the wiping lip, the interior section of the connecting segment becoming wider along the insertion direction.

The presence of a connecting segment becoming wider along the insertion direction and connecting the distal region of the tube to the proximal end of the wiping lip makes the lip longer, without modifying the diameter of the passage orifice, or modifying the diameter of the tube. This ensures effective wiping while reducing the force to be applied in order to pass the applicator through the wiper. The outer geometry of such a wiper is also not modified by such a connecting segment, this facilitating the implementation of the invention in bottles of existing packaging devices.

According to advantageous alternatives:

- the interior section of the wiping lip becomes continuously narrower along the wiping lip, from the proximal end of the wiping lip to the distal orifice of the wiping lip;
- the interior section of the connecting segment becomes continuously wider along the connecting segment, from the proximal end of the connecting segment to the distal end of the connecting segment; and
- the tube, the connecting segment and the wiping lip together define an interior wiper lumen, the interior wiper lumen being completely clear, in particular devoid of additional part, in the absence of the applicator;
- the proximal edge of the interior surface of the wiping lip constitutes the distal edge of the interior surface of the connecting segment.

According to a variant, the ratio of the height of the wiping lip to the height of the connecting segment, considered projected along the longitudinal axis, is between 12 and 6, better between 2 and 5, and preferably close to 3.

Such a ratio between the height of the wiping lip and the height of the connecting region along the longitudinal axis A-A' ensures sufficient widening of the region connecting the proximal end of the wiping lip to the connecting segment.

According to another variant, the distal region of the tube is cylindrical, the lip defining a frustoconical interior surface converging toward the longitudinal axis along the insertion direction and the connecting segment defining a frustoconical interior surface diverging from the axis along the insertion direction.

The geometry of revolution, and more specifically the sequence of frustoconical and cylindrical interior surfaces, is particularly advantageous, since it ensures an optimal operation simply and cost-effectively, while reducing the manufacturing complexity.

According to advantageous variants:

- the cone angle defining the interior surface of the lip is between 30° and 80°, the complementary angle, defined between a generatrix of the cone defining the interior surface 42 of the lip and a plane perpendicular to the longitudinal axis, being between 10 and 50°; and
- the cone angle defining the interior surface of the connecting segment is between 15 and 65°.

The dimensional characteristics previously described improve the flexibility of the lip. Indeed, the cone angle defining the interior surface of the connecting segment guarantees a sufficient widening of the region connecting the proximal end of the wiping lip to the connecting segment. The cone angle defining the interior surface of the lip also ensures increased flexion of the lip during the passage of the applicator in the distal passage orifice.

According to another variant, the thickness of the wiping lip is between 0.25 mm and 1.00 mm.

Such a thickness guarantees the structural integrity of the wiper over time, while ensuring increased flexibility of the lip.

According to advantageous variants:

- the wiper comprises a retaining gadroon around the tube; and
- the wiper comprises a securing lip around the tube, the securing lip being located distally relative to the retaining gadroon.

The presence of a retaining gadroon as well as a securing lip offer robust maintenance, as well as easier placement of the wiper on a container suitable for containing a cosmetic product.

According to other variants:

- the tube comprises a proximal neck having an interior section wider than the interior section of the distal region; and
- the tube inwardly delimits an interior shoulder between the proximal neck and the distal region.

The shoulder present between the proximal neck and the distal region, as well as the wider interior section of the proximal neck with respect to the interior section of the distal region allowing the insertion of a tool in the proximal neck to bear on the shoulder and thus apply a longitudinal insertion force of the wiper into a suitable container in order to contain a cosmetic product. Such a geometry facilitates the manufacture of a packaging device comprising the wiper.

The invention also relates to a device for packaging and application of a cosmetic product comprising:

- a container for containing a cosmetic product;
- a wiper as previously described, arranged in the container; and
- an applicator comprising a stem and a cosmetic product application head, the applicator being movable through the wiper between a position for storage in the container and a removed position.

Such a packaging device is particularly advantageous, since it allows optimal wiping of the applicator, while reducing the force to be applied in order to pass the head of the applicator through the wiper.

The invention also relates to a method for applying a cosmetic product, comprising the following steps:

- providing a device as previously described, the applicator being in its storage position;
- removing the applicator in a direction opposite the insertion direction; and
- bending of the wiping lip during the passage of the head through the distal passage orifice.

The method is advantageously characterized in that the wiping lip curls around a curling line during the passage of the head through the distal passage orifice, the distal edge of the lip being proximal relative to the curling line during the passage of the product application head through the lip.

Furthermore, the method preferably comprises, after the removal of the applicator from the container, the return of the distal edge of the lip into a distal position relative to the curling line.

The method for applying a cosmetic product according to the invention ensures an increased bending of the lip during the passage of the applicator, creating a removal that is neither insufficient nor excessive of the product present on the applicator while applying a reduced removal force of the applicator. The curling of the lip is especially advantageous in order to reduce the removal force of the applicator.

BRIEF DESCRIPTION OF THE SEVERAL VIEWS OF THE DRAWING

The invention will be better understood upon reading the following description, provided solely as an example, and in reference to the appended drawings, in which.

DETAILED DESCRIPTION OF THE DISCLOSURE

Within the meaning of the present invention, the term "distal" means further away from the user, and the term "proximal" means closer to the user during the use of the device. The use of the terms "distal" and "proximal" is to be understood here in the context of the invention when the wiper is installed on a container.

Figure 1:
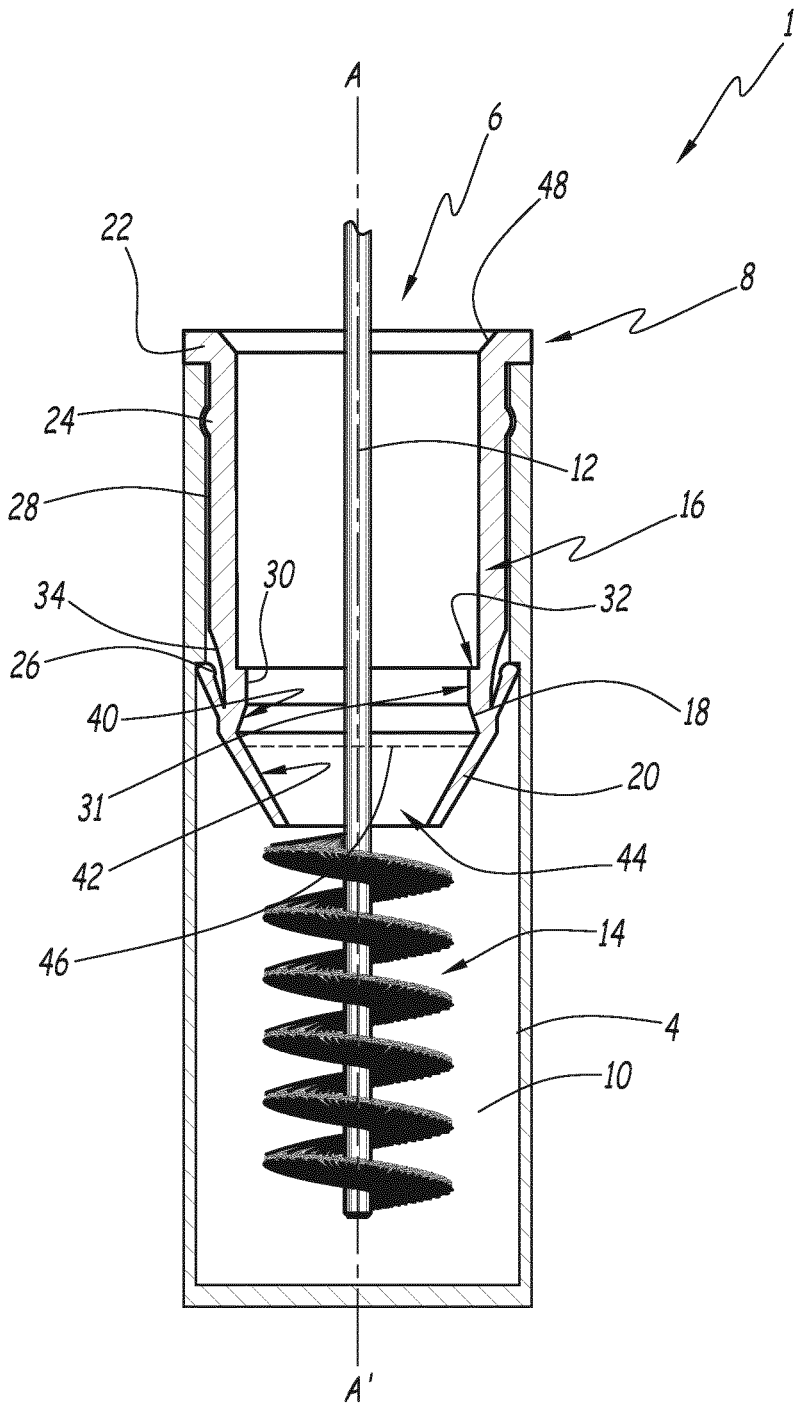
FIG. 1 is a schematic sectional view, along a median vertical plane of a device for packaging and application of a cosmetic product according to the invention.

A device for packaging and application of a cosmetic product 1 is partially shown in FIG. 1.

The device 1 comprises a container 4 containing a cosmetic product, an applicator 6 suitable for being introduced into the container 4 and a wiper 8 fastened on the container 4, the applicator 6 being configured to pass through the wiper 8.

The container 4 is for example elongated along an axis A-A' and defines an interior volume 10 containing a fluid makeup product, for example mascara. The container 4 comprises an axial opening, opening into the interior volume 10 at one of its ends. Advantageously, the container 4 is a bottle, for example made from glass, metal or plastic.

The applicator 6 comprises a stem 12 and a head 14 fastened in the alignment of the stem 12.

The stem 12 is suitable for being grasped by a user. At its proximal end, it has a stopper (not visible in the figures) appropriate for being mounted on the container 4 in order to close the interior volume 10. The stopper is appropriate for being grasped by the user in order to remove the stem and the applicator from the interior volume 10.

The head 14 of the applicator 6 is formed from multiple members for loading and application of products, such as pins. Each of these members is in particular suitable for being covered with makeup product. The applicator 6 here forms an application brush.

The applicator 6 is movable relative to the container 4. The applicator 6 is in particular movable between a storage position in the container and a removed position located away from the container.

When it is in the storage position in the container, the applicator 6 is at least partially inserted in the interior volume 10 defined by the container 4. The head 14 of the applicator 6 is then located in the interior volume.

When it is in the removed position, the applicator 6 is outside the container, for example in a position suitable for the application of cosmetic product on the user.

The applicator 6 is movable between its storage and removed positions by translation through the wiper 8 along the axis A-A'.

The wiper 8 is mounted stationary in the container 4. Advantageously, the wiper 8 is fastened in the opening of the container 4 opening onto the interior volume 10. It partially obstructs this opening.

The wiper 8 extends along the longitudinal axis A-A' and defines an insertion direction of the applicator 6 into the container 4 from a proximal end of the wiper 8 toward a distal end of the wiper 8.

The insertion direction is defined by the longitudinal axis A-A'. The insertion direction is oriented from the outside of the container 4 toward the inside of the container 4 when the wiper 8 is fastened on the container 4.

The wiper 8 also defines a removal direction of the applicator of longitudinal axis A-A' from a distal end of the wiper 8 toward a proximal end of the wiper 8, from the inside of the container 4 toward the outside of the container.

The wiper 8 is advantageously in one piece and formed from a flexible material.

The wiper 8 is preferably made from a resiliently deformable material.

The resiliently deformable material can be selected from thermoplastic or cross-linked elastomers, in particular EPDMs, natural rubbers, nitrile, butyl or silicone elastomers.

In the case of a cross-linked elastomer, the manufacture of the wiper is done in a compression mold, heated to the appropriate temperature.

In a variant, the resiliently deformable material is selected from polymers, for example polyolefins, such as polyethylene (PE) or thermoplastic polymers, such as polypropylene (PP), polybutylene terephthalate (PBT) or acrylonitrile butadiene styrene (ABS).

Figure 2:
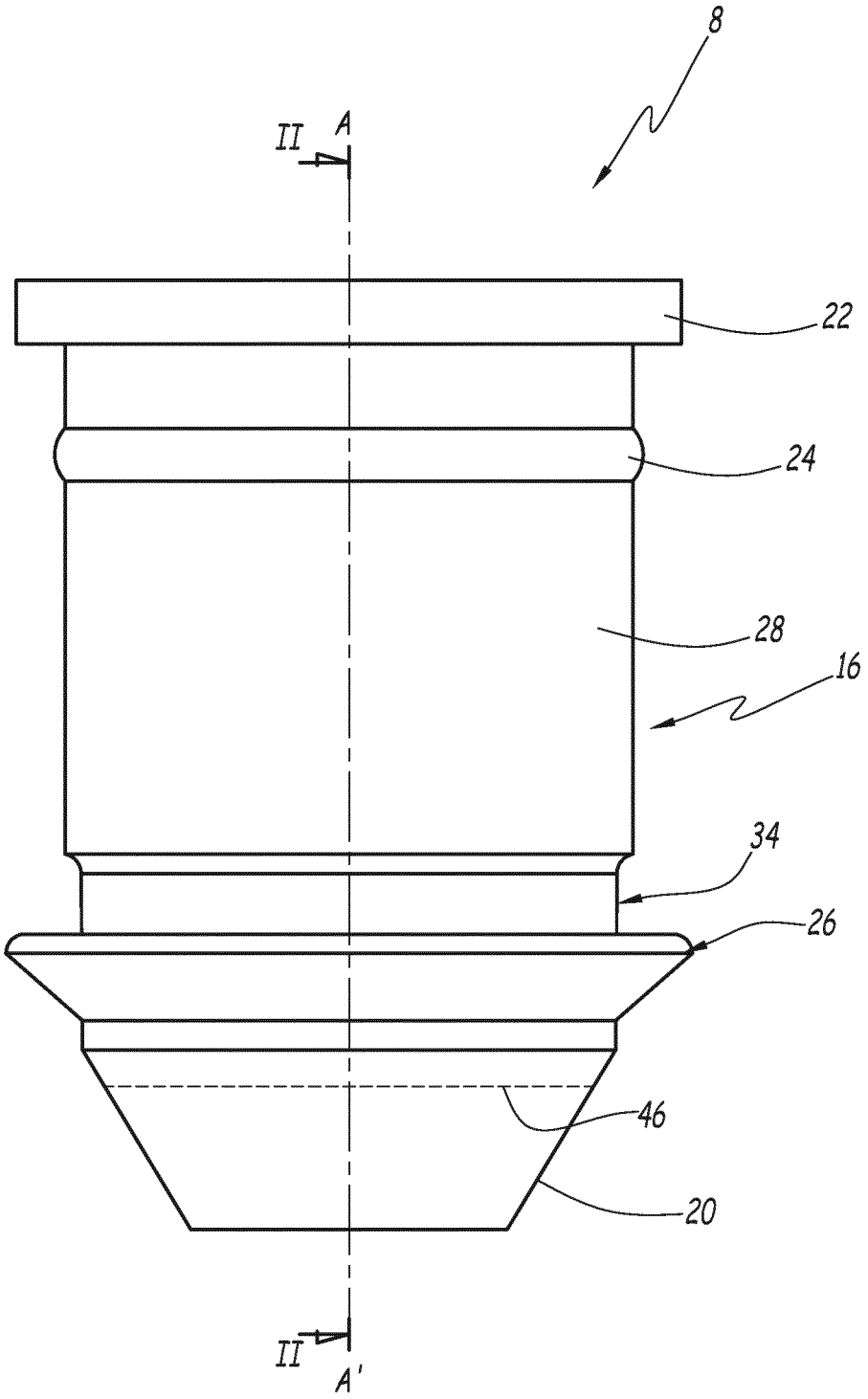
FIG. 2 is an elevation view of a wiper of the device of FIG. 1 according to the invention.
Figure 3:
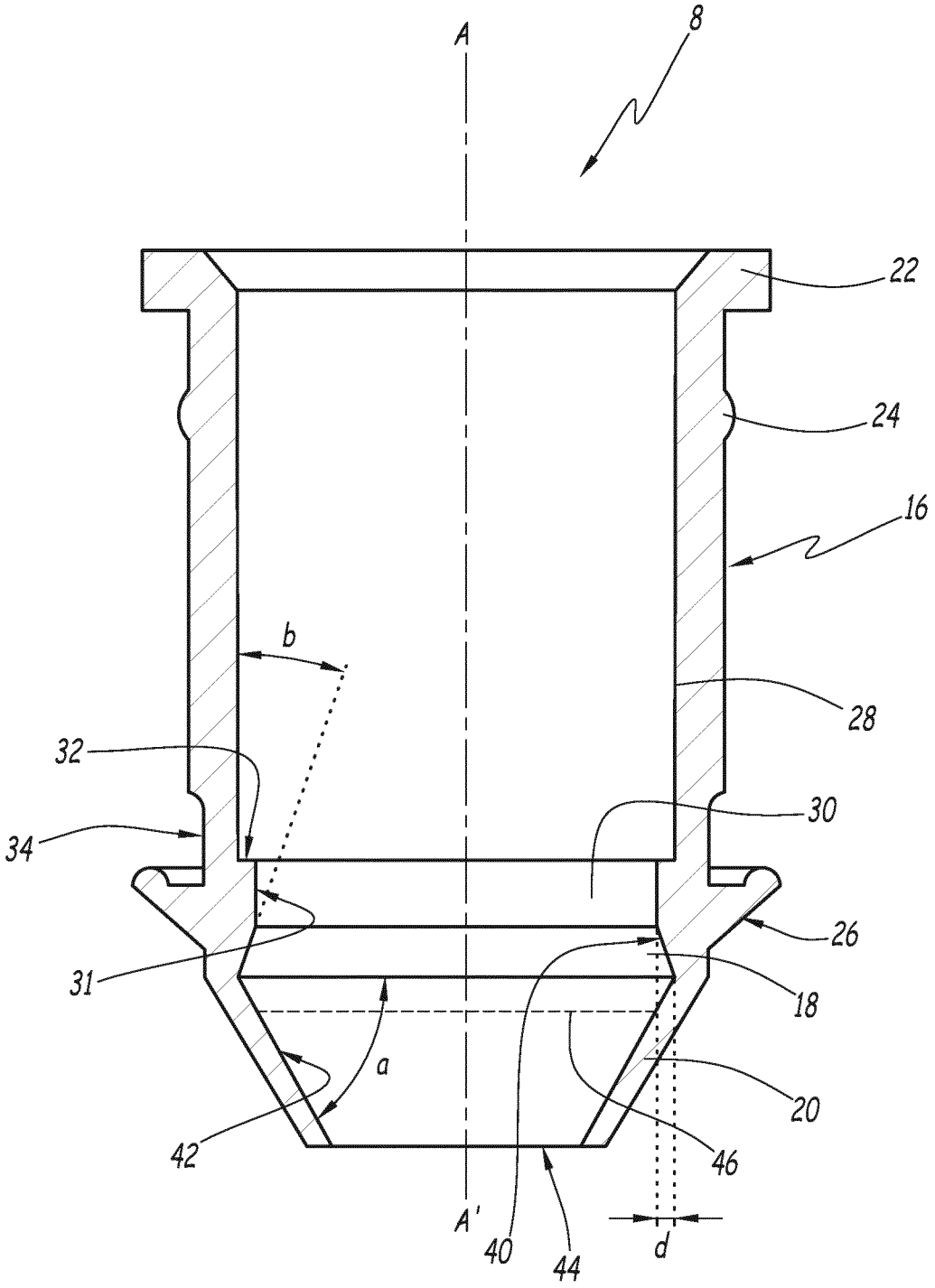
FIG. 3 is a sectional view along the vertical median plane of the wiper II-II of FIG. 2.

In reference to FIGS. 2 and 3, the wiper 8 comprises a tube 16, a connecting segment 18 and a wiping lip 20, the tube 16 being aligned along the longitudinal axis A-A' with the connecting segment 18 and the wiping lip 20.

The wiper 8 comprises, on its periphery, from its proximal end toward its distal end, a bearing flange 22 on the container. In this example, it comprises a retaining gadroon 24 and a securing lip 26.

The tube 16 comprises a proximal neck 28, a distal region 30 as well as an interior shoulder 32, connecting the proximal neck 28 to the distal region 30. The tube 16 defines an exterior narrowing 34 advantageously extending to the outside of the proximal neck 28 and the distal region 30.

The proximal neck 28 has a constant interior section. In the described embodiment, the inside of the proximal neck 28 is cylindrical with a constant diameter. The inner diameter of the proximal neck 28 is for example between 6 mm and 12 mm.

The distal region 30 has a constant interior section and defines an interior surface 31. In the described embodiment, the inside of the distal region 30 is cylindrical with a constant diameter. The inner diameter of the distal region 30 is smaller than the inner diameter of the proximal neck 28. The inner diameter of the distal region is for example between 4 mm and 10 mm.

The interior shoulder 32 connecting the proximal neck 28 to the distal region 30 is configured to receive a tool for installing the wiper 8 on the container 4 applying a force with axis A-A' in the insertion direction. The interior shoulder 32 for example extends along a plane substantially perpendicular to the longitudinal axis A-A'. It faces the proximal opening of the tube 16.

The exterior narrowing 34 is configured to allow the deformation of the securing lip 26 during the installation of the wiper on the container 4. The exterior narrowing 34 is proximal relative to the securing lip. In the example of FIGS. 1 to 3, the exterior narrowing 34 extends from a distal region of the proximal neck toward a proximal region of the distal region 30.

The connecting segment 18 is distal relative to the tube 16. The connecting segment 18 is located between the tube 16 and the lip 20. In particular, the connecting segment 18 connects a distal end of the distal region 30 to a proximal end of the lip 20.

The connecting segment 18 defines an interior surface 40 connected to the interior surface 31 of the distal region. The interior section of the connecting segment delimited by the interior surface 40 becomes wider along the longitudinal direction A-A' in the insertion direction, from top to bottom in the figures.

Advantageously, the interior surface 40 of the connecting segment 18 is frustoconical and diverges away from the axis A-A' in the insertion direction. The angle b of the cone defining the interior surface 40 of the connecting segment is illustrated in FIG. 3 and is defined as the half cone angle, formed between the axis A-A' and a generatrix of the cone. The angle b of the cone defining the interior surface 40 and the connecting segment is between 15 and 65°.

The inner diameter of the connecting segment 18 at its distal end is greater than the inner diameter of the connecting segment 18 at its proximal end. The inner diameter of the connecting segment 18 at its distal end is between 6 mm and 12 mm. The gap d between the inner radius of the connecting segment 18 at its distal end and the inner radius of the connecting segment 18 at its proximal end is illustrated in FIG. 3. The gap d is between 0.5 mm and 1.5 mm and is preferably substantially equal to 1 mm.

The lip 20 is distal relative to the connecting segment 18. In the embodiment shown in FIGS. 1 to 3, the lip 20 forms the distal end of the wiper.

The lip 20 defines an interior surface 42 connected to the interior surface 40 of the connecting segment. The interior section of the lip delimited by the interior surface 42 becomes narrower along the longitudinal direction A-A' in the insertion direction.

Advantageously, the interior surface 42 of the lip 20 is frustoconical and converges toward the axis A-A' in the insertion direction. The angle of the cone defining the interior surface 42 of the lip, also defined as the half cone angle, formed between the axis A-A' and a generatrix of the cone, is between 30° and 80°. The complementary angle a, measured between a generatrix of the cone defining the interior surface 42 of the lip and a plane perpendicular to the axis A-A, is between 10 and 50°. The angle is illustrated in FIG. 3.

The lip 20 defines, at its distal edge, a distal passage orifice 44. The minimum transverse span of the distal passage orifice 44 is smaller than the maximum transverse span of the head 14 to allow the wiping of the head 14 of the applicator 6 when the head 14 passes through the wiper 8.

In the embodiment shown in FIGS. 1 to 3, the distal passage orifice 44 is circular. The diameter of the distal passage orifice 44 is smaller than the diameter of the distal region 30 of the tube. The diameter of the distal passage orifice 44 is for example between 2 mm and 6 mm.

The height of the wiping lip 20, considered projected along the longitudinal axis A-A', is greater than the height of the connecting segment 18, considered projected along the longitudinal axis A-A'. More particularly, the ratio of the height of the wiping lip to the height of the connecting region, considered projected along the longitudinal axis A-A', is between 1 and 6, better between 2 and 5, and preferably close to 3.

The thickness of the lip is between 0.25 mm and 1 mm, preferably between 0.3 mm and 0.9 mm.

The lip 20 is able to bend when the head 14 of the applicator 6 passes through the distal passage orifice 44. In one specific example, the lip 20 is able to curl in the removal direction around a curling line 46, during the removal of the applicator 6.

The lip 20 and the connecting segment 18 form an undercut region at their connection.

The bearing flange 22 is located at the proximal end of the tube 16. It extends circumferentially around the axis A-A'. It protrudes past the outer surface of the neck. In the specific example of FIGS. 1 to 3 where the bearing flange 22 is a volume of revolution, the outer diameter of the bearing flange 22 is greater than the outer diameter of the tube 16.

In one specific example illustrated in FIGS. 1 to 3, the flange 22 comprises, at its proximal end, a bevel 48, the interior face of which is connected to the interior face of the bearing flange 22.

The flange 22 is arranged bearing against a proximal edge of the container 4 in order to block the movement of the wiper 8 relative to the container 4 in the insertion direction.

The gadroon 24 is located around the tube 16. It protrudes radially away from the axis A-A'. In the example of FIGS. 1 to 3, the gadroon 24 thus defines a widening of the outer diameter of the wiper 8 in the form of a bead.

The gadroon 24 is advantageously inserted into a groove of the container 4 and to block the axial movement of the wiper 8 relative to the container along the longitudinal axis A-A'.

The securing lip 26 extends around the tube 16. It is in the form of a skirt. It protrudes radially outward relative to the tube 16.

The securing lip 26 is deformable during the installation of the wiper 8 in the container 4. More specifically, the securing lip 26 is radially deformable to as to allow the passage of the securing lip 26 in the container 4, in particular by deforming radially toward the outer narrowing 34.

The securing lip 26 is proximal relative to the connecting segment 18.

When the wiper 8 is mounted in on the container 4, the securing lip 26 is in contact with an interior surface of the container 4 and is pressed against the interior surface of the container 4. This blocks the movement of the wiper 8 relative to the container 4 in the removal direction.

A method for applying a cosmetic product according to the invention will now be described.

The application method comprises providing a device 1 for packaging and application of a cosmetic product to a user.

The applicator 6 is in its storage position, the head 14 of the applicator 6 is in contact with the cosmetic product and advantageously bathes in the cosmetic product contained in the container 4.

Then, during a removal step, the user removes the applicator 6 from the container 4 by pulling the stem 12 in the removal direction along the longitudinal axis A-A'. The stem 12 moves by translating relative to the wiper 8, through the distal passage orifice 44 into contact by the head 14 with the lip 20.

During the removal, the lip 20 bends. The bending of the lip 20 occurs, all throughout the passage of the head 14 through the distal passage orifice 44.

The head 14 of the applicator 6 comes into contact with the lip 20. The contact between the lip 20 and the head 14 of the applicator 6 bends the lip in the removal direction and deforms the pins of the head 14 in the insertion direction. This contact between the lip 20 and the head 14 of the applicator 6 wipes the head 14 of the cosmetic product, ensuring adequate loading of the head 14 with cosmetic product.

In one specific embodiment, the lip 20 curls around the curling line 46 during the bending. Once the lip 20 is curled, the distal edge of the lip 20, defining the passage orifice 44, is in the proximal position relative to the curling line 46.

Once the applicator 6 is in the removed position, the lip 20 can return to its idle position, in which its distal edge is in the distal position relative to the curling line 46, or remain in its curled position until the applicator 6 is once again reinserted through the wiper, then returning the wiping lip toward its idle position.

The invention claimed is:

1. A wiper for a cosmetic product applicator for a container containing a cosmetic product, the wiper extending along a longitudinal axis (A-A') and defining an insertion direction of the applicator into the container from a proximal end of the wiper toward a distal end of the wiper, the wiper comprising:

a tube having a longitudinal axis (A-A'), the tube defining a distal region of constant interior section;

a wiping lip of the applicator of longitudinal axis (A-A'), having an interior section becoming narrower in the insertion direction of the applicator up to a distal passage orifice; and a connecting segment immediately adjacent to and directly connecting the distal region of the tube to a proximal end of the wiping lip, the interior section of the connecting segment becoming wider along the insertion direction;

wherein the distal region of the tube is cylindrical, the wiping lip defining a frustoconical interior surface converging toward the longitudinal axis (A-A') along the insertion direction and the connecting segment defining a frustoconical interior surface-diverging from the axis (A-A') along the insertion direction, the interior surface of the wiping lip being immediately adjacent to and directly connected to the interior surface of the connecting segment.

2. The wiper according to claim 1, wherein the ratio of the height of the wiping lip to the height of the connecting segment, considered projected along the longitudinal axis (A-A'), is between 1 and 6.

3. The wiper according to claim 2, wherein the cone angle defining the interior surface of the wiping lip is between 30° and 80°, the complementary angle, defined between a generatrix of the cone defining the interior surface of the wiping lip and a plane perpendicular to the longitudinal axis (A-A), being between 10 and 50°.

4. The wiper according to claim 2, wherein the cone angle (b) defining the interior surface of the connecting segment is between 15 and 65°.

5. The wiper according to claim 2, wherein the thickness of the wiping lip is between 0.25 mm and 1.0 mm.

6. The wiper according to claim 2, comprising a retaining gadroon around the tube.

7. The wipe according to claim 1, wherein the cone angle defining the interior surface of the wiping lip is between 30° and 80°, the complementary angle, defined between a generatrix of the cone defining the interior surface of the wiping lip and a plane perpendicular to the longitudinal axis (A-A), being between 10 and 50°.

8. The wiper according to claim 7, wherein the cone angle (b) defining the interior surface of the connecting segment is between 15 and 65°.

9. The wiper according to claim 7, wherein the thickness of the wiping lip is between 0.25 mm and 1.0 mm.

10. The wiper according to claim 1, wherein the cone angle (b) defining the interior surface of the connecting segment is between 15 and 65°.

11. The wiper according to claim 10, wherein the thickness of the wiping lip is between 0.25 mm and 1.0 mm.

12. The wiper according to claim 1, wherein the thickness of the wiping lip is between 0.25 mm and 1.0 mm.

13. The wiper according to claim 1, comprising a retaining gadroon around the tube.

14. The wiper according to claim 13, comprising a securing lip around the tube, the securing lip being located distally relative to the retaining gadroon.

15. The wiper according to claim 1, wherein the tube comprises a proximal neck having an interior section wider than the interior section of the distal region.

16. The wiper according to claim 15, wherein the tube inwardly delimits an interior shoulder between the proximal neck and the distal region.

17. A device for packaging and application of a cosmetic product comprising:

a container for containing a cosmetic product;

a wiper according to claim 1, arranged in the container;

an applicator comprising a stem and a cosmetic product application head, the applicator being movable through the wiper between a position for storage in the container and a removed position.

18. A method for applying a cosmetic product, comprising the following steps:

providing a device according to claim 17, the applicator being in its storage position;

removing the applicator in a direction opposite the insertion direction; and bending of the wiping lip during the passage of the cosmetic product application head through the distal passage orifice.

19. The method according to claim 18, wherein the wiping lip curls around a curling line during the passage of the head through the distal passage orifice, the distal edge of the wiping lip being proximal relative to the curling line during the passage of the product application head through the wiping lip.

20. The method according to claim 19, comprising, after the removal of the applicator from the container, the return of the distal edge of the wiping lip into a distal position relative to the curling line.

* * * * *